United States Patent [19]

Fechter

[11] Patent Number: 4,504,106

[45] Date of Patent: Mar. 12, 1985

[54] ELECTRICAL CORD SECURING APPARATUS

[76] Inventor: Max Fechter, 572 St. Charles St., Victoria, British Columbia, Canada, V8S 3N7

[21] Appl. No.: 499,295

[22] Filed: May 31, 1983

[51] Int. Cl.[3] ..... H01R 13/639

[52] U.S. Cl. ..... 339/75 P; 339/105

[58] Field of Search ..... 339/75 P, 105

[56] References Cited

U.S. PATENT DOCUMENTS

| | | | |
|---|---|---|---|
| 3,097,034 | 7/1963 | Jamrosy | 339/75 P |
| 3,781,761 | 12/1973 | Harwood | 339/75 P |
| 3,922,055 | 11/1975 | McGregor | 339/75 P |

*Primary Examiner*—John McQuade

*Attorney, Agent, or Firm*—Carver & Co.

[57] ABSTRACT

An apparatus secures together electrical cords having mutually engaged electrical contacting devices. The apparatus has a body and two S shaped members. The S shaped members are connected to the body so the members are on each side of the engaged electrical contacting devices.

4 Claims, 2 Drawing Figures

ELECTRICAL CORD SECURING APPARATUS

BACKGROUND OF THE INVENTION

This invention relates to an apparatus for securing electrical cords having a pair of S shaped members connected to a body.

Many devices have been developed in the past to secure together electrical contacting devices on extension cords. Typically these devices lock together a plug on the end of one extension cord with a socket on the end of a second extention cord. An example of such a device is found in U.S. Pat. No. 3,029,408 to Anderson. The problem with such devices is that stress is placed on the electrical connections between the cords and the plug and socket when the cords are pulled relative to each other.

Attempts have been made to provide devices of capable of holding the cords themselves together. For example, the device shown in U.S. Pat. No. 3,922,055 to McGregor has a spiral at each end for holding the cord. However, as shown in the drawings of this patent, the cords remain straight and therefore the cords tend to slip through the spirals when pulled. Therefore tension applied to the cords would tend to pull the plugs apart. In addition, there would appear to be a tendency for the cords to become unwound from the spiral.

Another extension cord connector is shown in U.S. Pat. No. 3,999,828 to Howell.

SUMMARY OF THE INVENTION

An apparatus secures together electrical cords having mutually engaged electrical contacting devices. The apparatus comprises a body and two S shaped members connected to the body so the members are on each side of the engaged electrical contacting devices.

Preferably, each of the S shaped members has a center bar extending perpendicular to the longitudinal direction of the cords and two hook portions facing in opposite directions connected to the bar on opposite sides thereof. Each of the members is shaped to tightly receive a loop of one of the cords so the cord passes over the hook portions on one side of the member and over the center bar on a side of the member opposite the one side.

The body and S shaped members may be of wire. The S shaped members are then welded or soldered to the body. Preferably, the body is a rectangular wire hoop.

DESCRIPTION OF THE PREFERRED EMBODIMENTS

Figure 1:
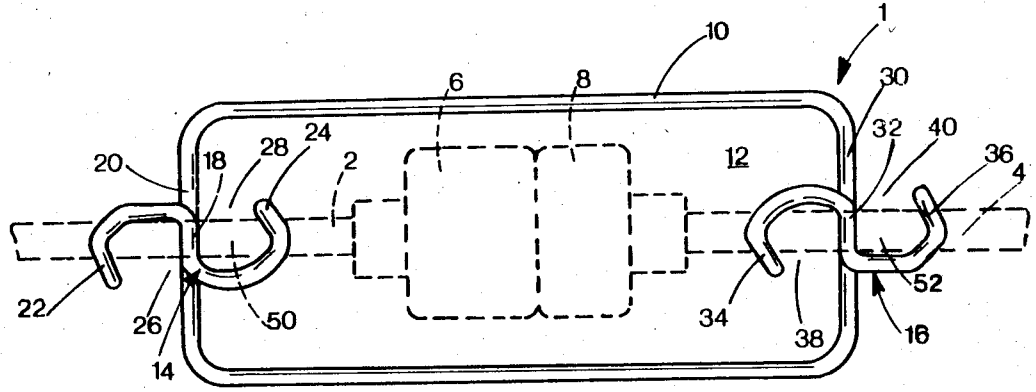
FIG. 1 is a plan view of an apparatus for securing together electrical cords, with the electrical cords and electrical contacting devices being shown in broken lines.

The drawings illustrate an apparatus 1 for securing together a pair of electrical cords 2 and 4 having mutually engaged electrical contacting devices 6 and 8. In the illustrated embodiment, device 8 is a common electrical plug having projecting prongs in electrical contact with wires within cord 4. Similarly, device 6 is a common electrical socket or receptacle having recesses for receiving the prongs of plug 8. Contact surfaces within the recesses are in electrical contact with wires in cord 2. The socket 6 and plug 8 are shown mutually engaged in the usual manner. This engagement depends upon friction between the prongs of the plug and the recesses of the socket.

The apparatus 1 has a body 10 in the form of a generally rectangular, stiff wire hoop. As may be seen, when the apparatus is in use, the plug 8 and socket 6 are located within center opening 12 of the body and the body extends beyond each side of the mutually engaged electrical contacting devices.

The apparatus also has a pair of identical S shaped members shown generally at 14 and 16. Member 14 has a center bar 18 which extends perpendicular to the longitudinal direction of cord 2. Center bar 18 is connected to side 20 of body 10 by welding or soldering. Member 14 also has two hook portions 22 and 24 having cord receiving openings 26 and 28 which face in opposite directions. Member 16 is identical to member 14 and is located on side 30 of body 10 which is opposite to side 20. Member 16 has a center bar 32 connected to side 30 of the body 10. Member 16 also has hook portions 34 and 36 defining openings 38 and 40 facing in opposite directions.

Figure 2:
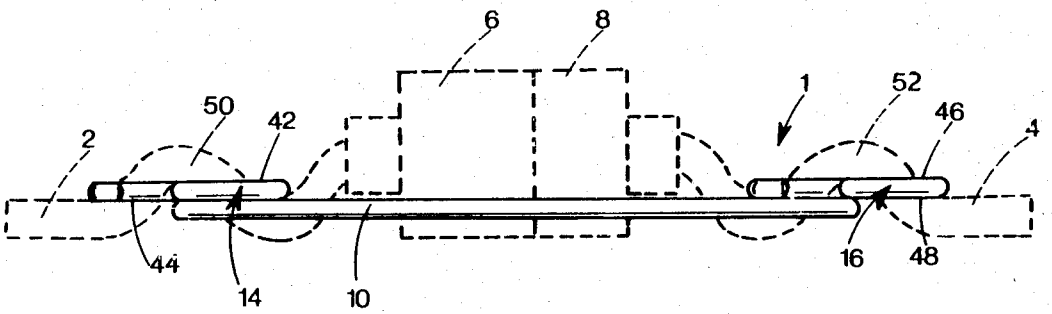
FIG. 2 is an elevational view of the apparatus of FIG. 1 with the cords and electrical contacting devices also shown in broken lines.

Member 14 has a first side 42 and a second side 44, both shown in FIG. 2. Side 42 is the top side in the illustrated embodiment and side 44 is the bottom side. Member 16 has a corresponding first side 46 and a second side 48.

S shaped member 14 is shaped to tightly receive a loop 50 of cord 2 as shown best in FIG. 2. The loop 50 passes over the center bar 18 on first side 42 of member 14 and passes over hook portions 22 and 24 on second side 44 of the member. The loop is positioned by placing the cord over first side 42 of member 14 and then inserting the cord through openings 26 and 28. Similarly, S shaped member 16 is shaped to tightly receive a loop 52 of cord 4. The loop 52 passes over center bar 32 on the first side 46 of member 16 and passes over hook portions 34 and 36 on the second side 48 of the member. The loop is formed by placing cord 4 over the first side 46 of the member and then inserting the cord through openings 38 and 40 of the hook portions 34 and 36 respectively.

Once the loops 50 and 52 are inserted in the S shaped members 14 and 16 as described above and illustrated in the drawings, they are held tightly in place. There is virtually no tendency for cords 2 and 4 to slip through S shaped members 14 and 16 when one or both cords are pulled outwardly from apparatus 1. Consequently, when the cords are pulled relative to each other, there is no tendency for socket 6 and plug 8 to become disengaged. Moreover, no strain is put on the connections between the wires in the cord and the respective electrical contacting devices.

What is claimed is:

1. An apparatus for securing together electrical cords having mutually engaged electrical contacting devices, the apparatus comprising a hoop-shaped body, the electrical contacting devices being receivable within the body, and two S shaped members connected to the body on opposite sides thereof so the electrical contacting devices are between the members, each of the S shaped members having a center bar extending perpendicular to the longitudinal direction of the cords and two hook portions facing in opposite directions connected to the bar on opposite sides thereof, each of the members being shaped to tightly receive a loop of one of the cords so the one cord passes over the hook portions on one side of the member and over the center bar on a side of the member opposite the one side.

2. An apparatus as claimed in claim 1, wherein the body and the S shaped members are of wire, the S shaped members being welded or soldered to the body.

3. An apparatus as claimed in claim 2, wherein the body is a rectangular hoop.

4. An apparatus as claimed in claim 3, wherein the center bars of the S shaped members are connected to the body.

* * * * *